United States Patent [19]

Neufeld

[11] 4,301,635

[45] Nov. 24, 1981

[54] COMPOSITE JOISTS, JOIST ASSEMBLIES AND BUILDING PANELS INCLUDING SUCH JOIST ASSEMBLIES

[75] Inventor: Garry J. Neufeld, Kelowna, Canada

[73] Assignee: Nu Floor Co. Ltd., Kelowna, Canada

[21] Appl. No.: 94,148

[22] Filed: Nov. 14, 1979

[51] Int. Cl.[3] ..... E04B 5/10; E04B 5/14

[52] U.S. Cl. ..... 52/483; 52/289; 52/690; 52/729

[58] Field of Search ..... 52/289, 690, 695, 376, 52/483, 317, 696, 821, 729, 827; 182/220, 182

[56] References Cited

U.S. PATENT DOCUMENTS

| | | | |
|---|---|---|---|
| 1,511,764 | 10/1924 | Jordahl | 52/690 |
| 3,871,481 | 3/1975 | Ballek | 182/228 |
| 3,973,367 | 8/1976 | Johnson et al. | 52/483 |
| 4,122,647 | 10/1978 | Kovar | 52/695 |

FOREIGN PATENT DOCUMENTS

| | | | |
|---|---|---|---|
| 128076 | 6/1919 | United Kingdom | 52/376 |
| 600280 | 3/1978 | U.S.S.R. | 52/827 |

*Primary Examiner*—John E. Murtagh

[57] ABSTRACT

The invention provides a composite metal and wood joist, a joist assembly, and a floor panel incorporating two or more of such joist assemblies connected by plywood floor panels. Each composite joist member consists of a metal channel having a plurality of nailable stiffening members disposed along its length, preferably one at each end and the others spaced uniformly along its length. A joist assembly consists of two spaced parallel joists, the assembly having a plurality of stiffening assemblies along its length, each stiffening assembly consisting of two adjacent stiffening members connected by a cross member.

7 Claims, 3 Drawing Figures

COMPOSITE JOISTS, JOIST ASSEMBLIES AND BUILDING PANELS INCLUDING SUCH JOIST ASSEMBLIES

FIELD OF THE INVENTION

The present invention is concerned with improvements in or relating to composite joists, joist assemblies and building panels including such joist assemblies, all for use in buildings.

REVIEW OF THE PRIOR ART

The conventional method of forming a floor in residential or light commercial buildings is to place a plurality of wooden floor joists parallel to one another between two parallel load-bearing longitudinal members, such as load-bearing walls or post-supported beams. Cross-bridging strips are then installed between the immediately adjacent pairs of joists to prevent twisting thereof. A sub-floor of tongue-and-groove plywood, or of diagonal-extending lumber, is then nailed to the joists. The construction of such a floor requires relatively skilled labour, and moreover is subject to the problems that the joists inevitably shrink, causing the nail heads to pop up, despite the use of anti-popping ringed nails, and the floor to squeak; the joists frequently shrink unevenly and an uneven floor then results.

Consequently there have been a number of prior proposals to employ metal joists in such buildings, but the metal joists proposed tend to be heavy and consequently relatively expensive, and are difficult to attach the sub-floor thereto without special fastenings.

A prior art novelty search carried out in respect of this invention in class 52 (Static structures e.g. buildings) sub-classes 364 (installed unit with specified feature retaining penetrating fastener), 376 (composite, including pierceable nonmetal component), 685 (openwork spacer positions crossed supported member type), and 828 (composite prefabricated panels with separate stiffener spaced inwardly of edge face) revealed U.S. Pat. Nos: 385,624; 1,863,692; 2,167,835; 2,181,169; 2,605,867; 3,235,662; 3,668,828 and 3,849,956 which received consideration. A review of these patents show that various prior inventors have attempted to solve the above-mentioned problem of fastening to metal building members by providing metal floor joists of different forms with longitudinal wood nailing strips mounted on their upper surfaces, or fastened thereto, the conventional sub-floor being nailed to the nailing strips and thus to the joists after their assembly into the building structure.

DEFINITION OF THE INVENTION

It is therefore an object of the invention to provide a composite joist of new form, especially suited for use as a floor, ceiling or roof joist in residential and light commercial construction.

It is another object to provide a new joist assembly particularly suited for such construction.

It is a further object to provide a new lightweight floor, ceiling or roof panel particularly suited for such construction.

In accordance with the present invention there is provided a composite joist comprising:

an elongated metal channel member of U cross-section adapted to be disposed with the channel cross web vertical and the opposed channel side walls horizontal, and a plurality of nailable stiffening members disposed along the length of the channel member, each stiffening member being disposed wholly within the channel and being of a height to extend between and engage the opposed channel side walls to provide corresponding vertical stiffening for the channel member.

Also in accordance with the present invention there is provided a joist assembly comprising:

two parallel elongated metal channel members both of U cross-section disposed with the channel open mouths facing one another and adapted to be disposed with the parallel channel cross webs vertical and the opposed parallel channel side walls horizontal, and a plurality of spaced stiffening assemblies disposed along the length of the assembly, each stiffening assembly comprising two stiffening members connected by a transverse connecting member, each stiffening member being disposed wholly within the channel and being of a height to extend between and engage the opposed channel sidewalls to provide corresponding vertical stiffening to the channel member.

Further in accordance with the invention there is provided a building panel comprising two spaced parallel joist assemblies as specified in the immediately preceding paragraph in combination with a plurality of slab floor panels connected to the said joist assemblies to close the space to one face thereof and provide a sub-floor therefor.

DESCRIPTION OF THE DRAWINGS

A composite joist, a composite joist assembly and a building panel in accordance with the invention will now be described, by way of example, with reference to the accompanying diagrammatic drawings, wherein.

DESCRIPTION OF THE PREFERRED EMBODIMENTS

The floor construction is illustrated by way of example only as mounted on two spaced parallel load-bearing walls 10, either or both of which can of course be replaced by any other conventional load-bearing structure, such as a postsupported beam. The top of each wall is provided with the usual respective plate member 12 on which rests the respective ends of composite building panels 14. Only two panels are illustrated, but of course the required number to provide a complete floor will be employed.

Figure 1:
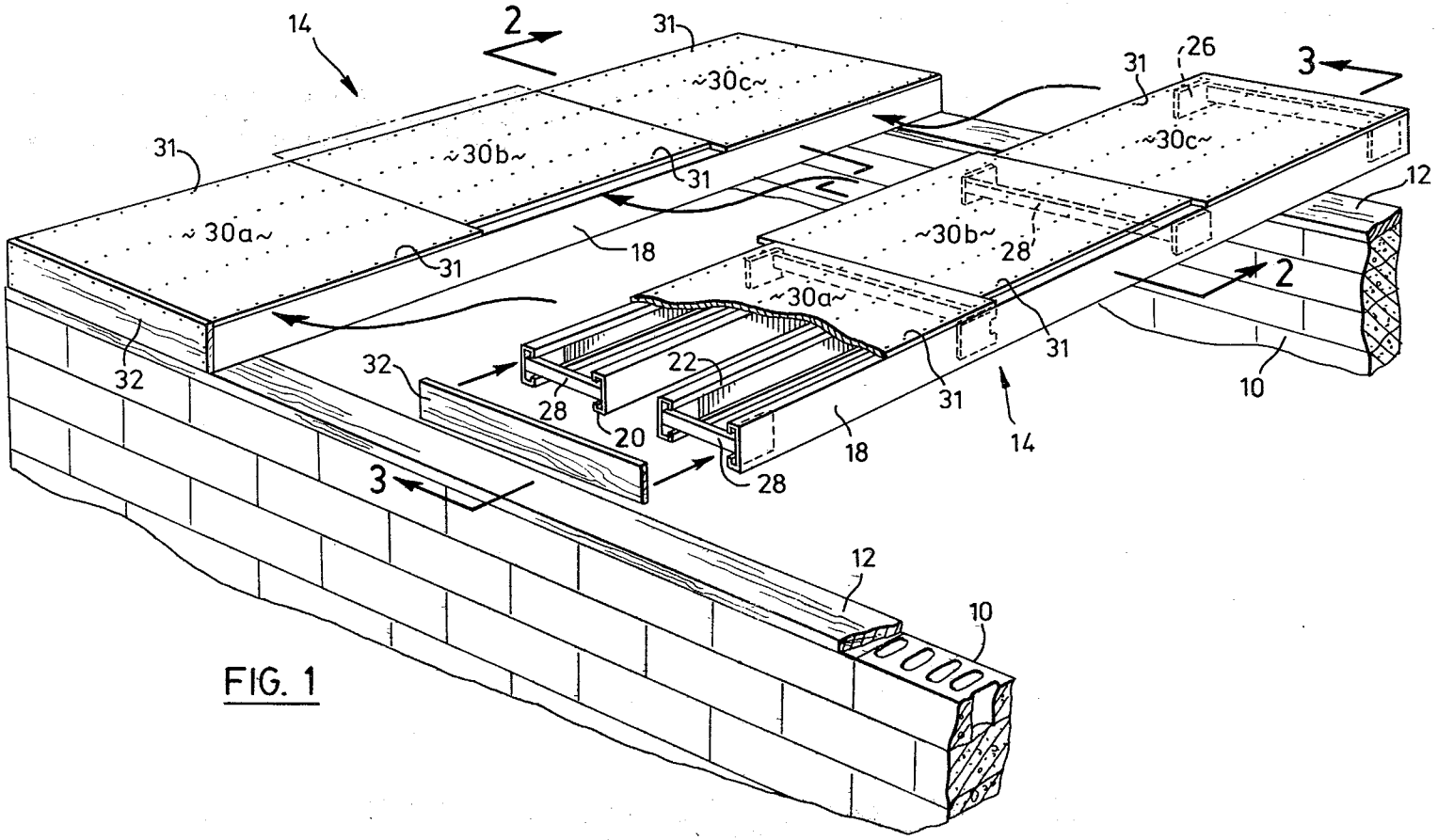
FIG. 1 is a perspective view of a portion of a floor construction for residential or light industrial buildings, parts being shown exploded and broken away as necessary for clarity of illustration.
Figure 2:
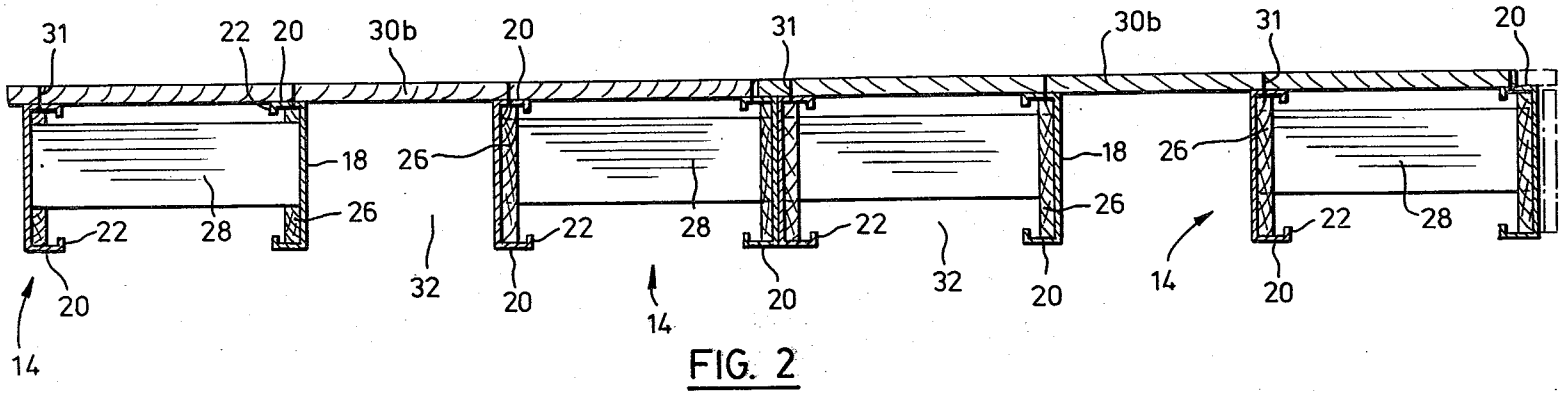
FIG. 2 is a section taken on the lines 2—2 of FIG. 1, but with the two building panels thereof butted against one another.
Figure 3:
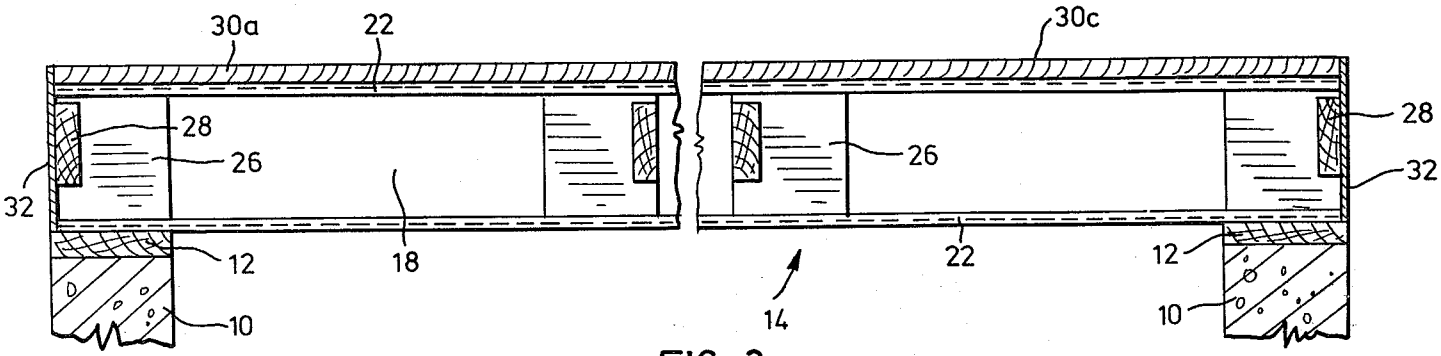
FIG. 3 is a section taken on the line 3—3 of FIG. 1.

Referring now also to FIGS. 2 and 3 each floor panel consists of two spaced composite joist assemblies of the invention disposed side by side and parallel to one another. Each assembly consists of two parallel elongated spaced channel members 16 of U cross-section disposed with the open channel mouths facing one another. Each channel has a flat cross web 18 disposed vertically and two parallel side walls 20 disposed horizontally, each of which side walls terminates in a respective return web 22 parallel to the cross web 18, so as to stiffen the channel member vertically. Each assembly is completed by a plurality of longitudinally-spaced stiffening assemblies 24, each of which consists of two correspondingly spaced nailable stiffening members 26 connected together by a transverse connecting member 28 nailed thereto.

Each floor panel is completed by three panel subfloor members 30*a*, 30*b* and 30*c* fastened by rivets 31 to the joist assemblies, the central member 30*b* being jogged transversely relative to the two end members as illustrated for a reason described below, and by two end closure members 32 fastened to the adjacent nailable members 26 and the edge of the respective panel 30*a* or 30*c*. The nailable members 26 in this embodiment comprise rectangular plywood panels which fit wholly within the channel of the respective channel member. The panels are also of the height necessary to extend between the opposed side walls 20 and to engage the side walls, so as to provide corresponding vertical stiffening for the channel member. The preferred structure for the panel members is that each is provided with a stiffener assembly at each end, and two intervening assemblies, each of the latter being disposed at the junction of two of the panel members 30. When the two panels are disposed side by side the jogged centre members 30*b* overlap to the next panel and can be riveted thereto, so that the panels are securely connected together. They will also be connected to the plates 12 by toenailing through the wood end closure members.

It will be apparent that I have provided a simple composite joist, joist assembly and panel structure that is light in weight while sufficiently rigid for domestic and light industrial construction; since they are all based on a metal channel or channels they are also stable in dimensions and in resistance to subsequent twisting. The stiffening members preferably are of wood, particularly plywood, because of the composite action that is provided, the wood acting as a particularly effective sound and vibration dampening medium. Other materials such as cast aluminum or moulded plastic of the same configuration can be used instead of the wood members. The parts of a wooden stiffening assembly are nailed together, while the stiffening assemblies themselves are fastened to their respective joists by nailing or riveting.

The use of rivets for fastening the panels 30 to the metal channels makes it possible to provide a floor structure that is squeak-free upon installation and should remain squeak-free during its useful life, since rivets will not work loose in the floor in the same way as nails in a conventional wood floor. The panels can be shop prefabricated using relatively unskilled labour and their installation requires a minimum of carpentry skill. In a specific example each channel is rolled from sheet steel of 26 gauge U.S.S.G. (i.e. 0.045 cm or 0.018 inch) thickness (this being the minimum thickness which I would wish to use) so as to have a cross web 18 of 15.24 cm (6 inch) depth, the resulting panels spanning a width of 3.65 meters (12 feet) and being 81.28 cm. (32 inches) wide and 16.51 cm (6.5 inches) thick. Each side wall 20 is of 3.17 cm (1.25 inch) depth while the return webs 22 are of 1.9 cm (0.75 inch) depth. Each stiffening member 26 is a plywood panel of 15.24 by 15.24 cm (6 by 6 inches) and 1.27 cm (0.5 inch) thickness, while the connecting member 28 is a piece of lumber measuring 3.8 cm by 8.9 cm (1.5 inch by 3.5 inch) of the required length. Each panel member 30 measures 81.28 cm by 121.92 cm (32 inches by 48 inches) and is of 1.27 cm (0.05 inch) thickness. Channels, stiffening and panel members of other dimensions will of course be used for other joists, joist assemblies and panels of the invention. The channels employed in the invention will usually be either of sheet steel or aluminum or extruded aluminum. The channels may be provided in their cross webs and/or their side walls with ridges which increase the rigidity of the web and wall respectively.

I claim:

1. A joist assembly comprising:

two individual parallel elongated metal channel members both of U cross-section disposed with the channel open mouths facing one another and adapted to be disposed with the parallel channel cross webs vertical and the opposed parallel channel side walls horizontal, the channel side wall of each member having returned stiffening webs parallel to said web and defining edges of the open mouth, and a plurality of spaced stiffening assemblies disposed along the length of the assembly, each stiffening assembly comprising two stiffening members connected by a transverse connecting member, each stiffening member being disposed wholly within the channel and being of a height to extend between and engage the opposed channel sidewalls and to be provided with restraining in its disposition by said returned webs to provide corresponding vertical stiffening to the channel member, wherein the stiffening member of each stiffening assembly is a panel of wood.

2. A joist assembly as claimed in claim 1, wherein the assembly is provided with a stiffening assembly at each end, with the respective transverse connecting member disposed at the assembly end, and with at least one other stiffening assembly end, and with at least one other stiffening assembly, all of the stiffening assemblies being uniformly spaced from one another.

3. A joist assembly as claimed in claim 1, wherein the stiffening member of each stiffening assembly is a panel of plywood, the plywood stiffening members being connected by a wood transverse connecting member nailed to the stiffening members.

4. A building panel comprising two spaced, parallel joist assemblies as claimed in claim 1, and a plurality of slab floor panels riveted to the said joist assemblies to close the space to one face thereof and provide a sub-floor therefor.

5. A building panel comprising two spaced, parallel joist assemblies as claimed in claim 2, a plurality of slab floor panels riveted to the said joist assemblies to close the space to one face thereof and provide a sub-floor therefor, and two end members fastened respectively to the stiffening assembly transverse connecting members at the ends of the panels to close the respective ends.

6. A building panel comprising two spaced, parallel joist assemblies as claimed in claim 1, and a plurality of slab floor panels riveted to the said joist assemblies to close the space to one face thereof and provide a sub-floor therefor.

7. A building panel comprising two spaced, parallel joist assemblies as claimed in claim 3, and a plurality of slab floor panels riveted to the said joist assemblies to close the space to one face thereof and provide a sub-floor therefor.

* * * * *